US008570251B2

(12) United States Patent
Park

(10) Patent No.: US 8,570,251 B2
(45) Date of Patent: Oct. 29, 2013

(54) DC-DC CONVERTER, ORGANIC ELECTROLUMINESCENT DISPLAY DEVICE INCLUDING THE SAME, AND METHOD OF DRIVING THE ORGANIC ELECTROLUMINESCENT DISPLAY DEVICE

(75) Inventor: Sung Cheon Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 375 days.

(21) Appl. No.: 12/984,943

(22) Filed: Jan. 5, 2011

(65) Prior Publication Data

US 2011/0273111 A1 Nov. 10, 2011

(30) Foreign Application Priority Data

May 6, 2010 (KR) ..... 10-2010-0042584

(51) Int. Cl.
*G09G 3/30* (2006.01)

(52) U.S. Cl.
USPC ..... 345/76; 345/211; 315/169.3

(58) Field of Classification Search
USPC ..... 315/55, 76, 77, 204, 211, 169.3, 169.1; 345/55, 76, 77, 204, 211
See application file for complete search history.

(56) References Cited

U.S. PATENT DOCUMENTS

| | | | |
|---|---|---|---|
| 2002/0015033 | A1 | 2/2002 | Kim |
| 2003/0043090 | A1 * | 3/2003 | Yazawa et al. ..... 345/76 |

FOREIGN PATENT DOCUMENTS

| | | | |
|---|---|---|---|
| JP | 2004-266674 | | 9/2004 |
| JP | 3748262 | | 12/2005 |
| JP | 2006-340587 | | 12/2006 |
| KR | 10-0348275 | B1 | 8/2002 |
| KR | 10-2004-0061488 | | 7/2004 |
| KR | 10-2007-0063737 | A | 6/2007 |
| KR | 10-2007-0099800 | A | 10/2007 |
| KR | 10-2008-0062774 | A | 7/2008 |
| KR | 10-2008-0082047 | | 9/2008 |
| KR | 10-2008-0090879 | | 10/2008 |
| KR | 10-2008-0095024 | | 10/2008 |
| KR | 10-2009-0095135 | | 9/2009 |

OTHER PUBLICATIONS

KIPO Registration Determination Certificate dated Apr. 18, 2012, for Korean Patent application 10-2010-0042583, (5 pages).
KIPO Registration Determination Certificate dated Nov. 18, 2011, for Korean priority Patent application 10-2010-0042584, noting listed references in this IDS, 5 pages.
English-language abstract of Japanese Publication No. 2005-020833.
U.S. Appl. No. 13/005,974, filed Jan. 13, 2011, Sung Cheon Park, Samsung Mobile Display Co., Ltd.

* cited by examiner

*Primary Examiner* — David H Vu
(74) *Attorney, Agent, or Firm* — Christie, Parker & Hale, LLP

(57) ABSTRACT

In order to adjust a black level by using a power supply voltage, an organic electroluminescent display device includes: a plurality of scan lines arranged in a row direction; a plurality of data lines arranged in a column direction; a plurality of pixels formed at intersections between the plurality of scan lines and the plurality of data lines; and a direct current (DC)-DC converter to supply a power supply voltage to the plurality of pixels, wherein the DC-DC converter includes a set resistor, and to convert a reference voltage selected according to a set voltage determined by the set resistor into a power supply voltage and to supply the power supply voltage to the plurality of pixels.

20 Claims, 6 Drawing Sheets

DC-DC CONVERTER, ORGANIC ELECTROLUMINESCENT DISPLAY DEVICE INCLUDING THE SAME, AND METHOD OF DRIVING THE ORGANIC ELECTROLUMINESCENT DISPLAY DEVICE

CROSS-REFERENCE TO RELATED APPLICATION

This application claims the benefit of Korean Patent Application No. 10-2010-0042584, filed on May 6, 2010, in the Korean Intellectual Property Office, the disclosure of which is incorporated herein by reference.

BACKGROUND

1. Field

An aspect of the present invention relates to a direct current (DC)-DC converter, a method of driving the same, an organic electroluminescent display device including the DC-DC converter, and a method of driving the organic electroluminescent display device.

2. Description of the Related Art

Various flat panel display devices have recently been developed to overcome the disadvantages of cathode ray tubes, which are heavy and large. Examples of flat panel display devices include liquid crystal display devices, field emission display devices, plasma display panels, and organic electroluminescent display devices.

Among flat panel display devices, organic electroluminescent display devices display images by using organic light emitting diodes (OLEDs) that emit light due to recombination between electrons and holes.

Organic electroluminescent display devices are increasingly being used in various devices such as televisions, mobile phones, personal digital assistants (PDAs), MPEG audio layer-3 (MP3) players, and digital cameras because they have good color reproduction and small thickness.

SUMMARY

An aspect of the present invention provides a direct current (DC)-DC converter for adjusting a black level by using a power supply voltage, a method of driving the DC-DC converter, an organic electroluminescent display device including the DC-DC converter, and a method of driving the electroluminescent display device.

According to an aspect of the present invention, there is provided an organic electroluminescent display device including: a plurality of scan lines arranged in a row direction; a plurality of data lines arranged in a column direction; a plurality of pixels formed at intersections between the plurality of scan lines and the plurality of data lines; and a direct current (DC)-DC converter for supplying a power supply voltage to the plurality of pixels, wherein the DC-DC converter comprises a set resistor, and converts a reference voltage selected according to a set voltage determined by the set resistor into a power supply voltage and supplies the power supply voltage to the plurality of pixels.

According to another aspect of the present invention, the set resistor may be exchangeable, and have a resistance that is variable.

The DC-DC converter may include: the set resistor; a reference voltage generating unit for generating a plurality of reference voltages; a reference voltage selecting unit for selecting one reference voltage from among the plurality of reference voltages according to the set voltage determined by the set resistor; and a power supply voltage generating unit for converting the selected reference voltage into the power supply voltage to be supplied to the plurality of pixels.

According to another aspect of the present invention, the set resistor may be located separate from the other elements of the DC-DC converter.

The reference voltage selecting unit may include: a comparing unit for comparing the set voltage with a comparative voltage; and a selecting unit for selecting the one reference voltage from among the plurality of reference voltages according to a result of the comparison performed by the comparing unit.

The comparing unit may include at least one comparator including a first terminal to which the set voltage is applied and a second terminal to which the comparative voltage is applied, and designed to output an output value by comparing the set voltage with the comparative voltage.

According to another aspects of the present invention, the selecting unit may select the one reference voltage according to the output value of the at least one comparing unit.

According to another aspect of the present invention, there is provided a DC-DC converter including: a set resistor; a reference voltage generating unit for generating a plurality of reference voltages; a reference voltage selecting unit for selecting one reference voltage from among the plurality of reference voltages according to a set voltage determined by the set resistor; and a power supply voltage generating unit for converting the selected reference voltage into a power supply voltage to be supplied to a plurality of pixels.

According to another aspect of the present invention, the set resistor may be exchangeable, and have a resistance that is variable.

According to another aspect of the present invention, the set resister may be located separate from the other elements of the DC-DC converter.

The reference voltage selecting unit may include: a comparing unit for comparing the set voltage with a comparative voltage; and a selecting unit for selecting the one reference voltage from among the plurality of reference voltages according to a result of the comparison performed by the comparing unit.

The comparing unit may include at least one comparator including a first terminal to which the set voltage is applied and a second terminal to which the comparative voltage is applied, and designed to output an output value by comparing the set voltage with the comparative voltage.

The selecting unit may select the one reference voltage according to the output value of the at least one comparator.

According to another aspect of the present invention, there is provided a method of driving an organic electroluminescent display device including a plurality of scan lines arranged in a row direction, a plurality of data lines arranged in a column direction, a plurality of pixels formed at intersections between the plurality of scan lines and the plurality of data lines, and a DC-DC converter for supplying a power supply voltage to the plurality of pixels, the method including: receiving a set voltage determined by a set resistor; selecting one reference voltage from among a plurality of reference voltages according to the set voltage; and converting the selected reference voltage into a power supply voltage and supplying the power supply voltage to the plurality of pixels.

According to another aspect of the present invention, the set resistor may be exchangeable, and have a resistance that is variable.

According to another aspect of the present invention, the set resistor may be located separate from other elements of the DC-DC converter.

According to another aspect of the present invention, there is provided a method of driving a DC-DC converter for supplying a power supply voltage to a plurality of pixels, the method including: receiving a set voltage determined by a set resistor; selecting one reference voltage from among a plurality of reference voltages according to the set voltage; and converting the selected reference voltage into a power supply voltage and supplying the power supply voltage to the plurality of pixels.

The set resistor may be exchangeable, and have a resistance that is variable.

The set resistor may be located separate from other elements of the DC-DC converter.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
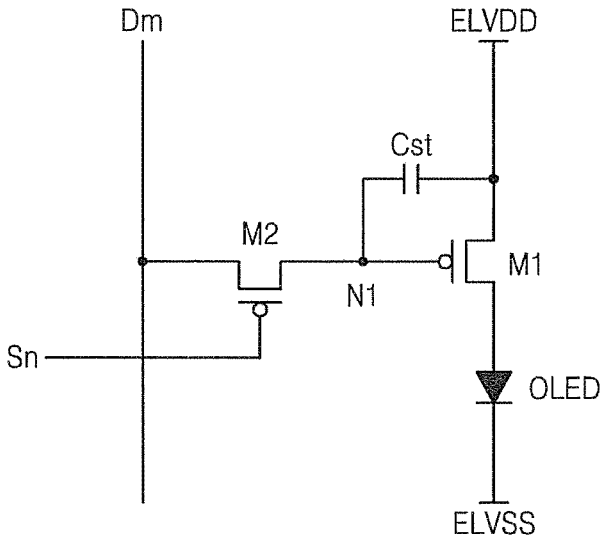
FIG. 1 is a circuit diagram illustrating a structure of a pixel included in an organic electroluminescent display device, according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

While such terms as "first," "second," etc., may be used to describe various components, such components must not be limited to the above terms. The above terms are used only to distinguish one component from another.

The terms used in the present specification are merely used to describe particular embodiments, and are not intended to limit the scope of the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

The aspects of the present invention may be described in terms of functional block components and various processing steps. Such functional blocks may be realized by any number of hardware and/or software components configured to perform the specified functions. For example, the aspects of the present invention may employ various integrated circuit components, e.g., memory elements, processing elements, logic elements, look-up tables, and the like, which may carry out a variety of functions under the control of one or more microprocessors or other control devices. Similarly, where the elements of the aspects of the present invention are implemented using software programming or software elements, the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the aspects of the present invention could employ any number of conventional techniques for electronics configuration, signal processing and/or control, data processing and the like. The words mechanism, element, means, and configuration are used broadly and are not limited to mechanical or physical embodiments, but can include software routines in conjunction with processors, etc.

The embodiments of the present invention will be described below in more detail with reference to the accompanying drawings. Those components that are the same or are in correspondence are rendered the same reference numeral regardless of the figure number, and redundant explanations are omitted.

Although an organic electroluminescent display device is explained, the aspects of the present invention are not limited thereto. That is, the technical scope of the present invention may encompass various flat panel display devices.

FIG. 1 is a circuit diagram illustrating a structure of a pixel included in an organic electroluminescent display device, according to an embodiment of the present invention.

Referring to FIG. 1, the pixel includes a pixel circuit including a first transistor M1, a second transistor M2, and a storage capacitor Cst, and an organic light-emitting diode (OLED).

The first transistor M1 has a source electrode to which a first power supply voltage ELVDD is transmitted, a drain electrode connected to the OLED, and a gate electrode connected to a first node N1. The second transistor M2 has a source electrode connected to a data line Dm, a drain electrode connected to the first node N1, and a gate electrode connected to a scan line Sn. The storage capacitor Cst has a first electrode to which the first power supply voltage ELVDD is transmitted and a second electrode connected to the first node N1. The OLED includes an anode, a cathode, and a light-emitting layer, and the anode is connected to the drain electrode of the first transistor M1 and a second power supply voltage ELVSS is transmitted to the cathode. When current flows from the anode to the cathode of the OLED, the light-emitting layer emits light according to the amount of the current flowing from the anode to the cathode. Equation 1 shows current flowing through the drain electrode of the first transistor M1.

$$I_d = \frac{\beta}{2}(ELVDD - Vdata - Vth)^2 \quad \text{[Equation 1]}$$

where $I_d$ is the current flowing through the drain electrode of the first transistor M1, Vdata is a voltage of a data signal, ELVDD is the first power supply voltage transmitted to the source electrode of the first transistor M1, Vth is a threshold voltage of the first transistor M1, and β is a constant.

Figure 2:
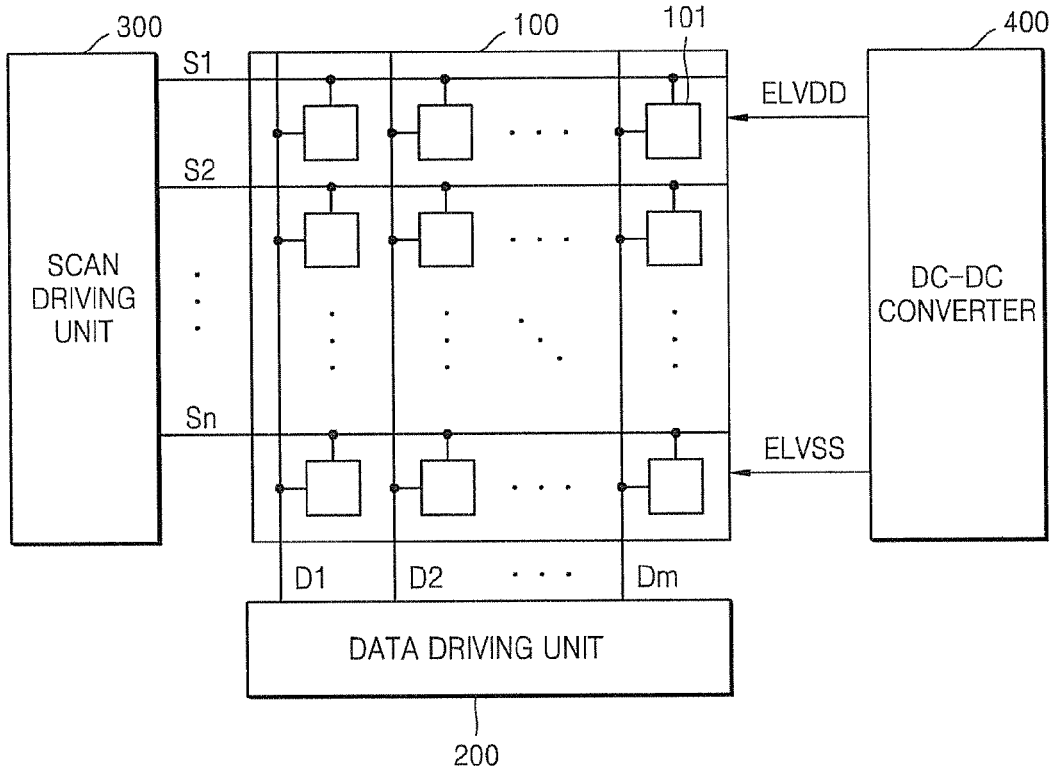
FIG. 2 is a block diagram of an organic electroluminescent display device according to an embodiment of the present invention.

FIG. 2 is a block diagram of an organic electroluminescent display device according to an embodiment of the present invention.

Referring to FIG. 2, the organic electroluminescent display device includes a pixel unit 100, a data driving unit 200, a scan driving unit 300, and a direct current (DC)-DC converter 400.

The pixel unit 100 includes a plurality of pixels 101 each of which includes an OLED for emitting light according to a flow of current. In the pixel unit 100, n scan lines S1, S2, . . . Sn−1, Sn for transmitting scan signals are formed in a row direction, and m data lines D1, D2, . . . Dm−1, Dm for transmitting data signals are formed in a column direction. Each of the pixels 101 receives from the DC-DC converter 400 power supply voltages, that is, a first power supply voltage ELVDD and a second power supply voltage ELVSS, and drives the OLED by using the first and second power supply voltages ELVDD and ELVSS. Accordingly, the pixel unit 100 receives the scan signals, the data signals, the first power supply voltage ELVDD, and the second power supply voltage ELVSS and makes the OLEDs emit light, thereby displaying images.

The data driving unit 200 for respectively applying data signals to the pixels 101 receives video data, for example, red, green, and blue (RGB) data, and generates data signals. The data driving unit 200 is connected to the data lines D1, D2, . . . Dm−1, Dm of the pixel unit 100 and respectively applies the data signals to the pixels 101.

The scan driving unit 300 for respectively applying scan signals to the pixels 101 is connected to the scan lines S1, S2, . . . Sn−1, Sn and respectively transmits the scan signals to the pixels 101. The data signals output from the data driving unit 200 are transmitted to the pixels 101 to which the scan signals are transmitted, so that driving currents are generated in pixel circuits and flow to the OLEDs.

The DC-DC converter 400 receives a predetermined DC power supply from a power supply generating unit (not shown), changes a voltage level, generates a first power supply voltage ELVDD and a second power supply voltage ELVSS suitable for the pixel unit 100, and transmits the first power supply voltage ELVDD and the second power supply voltage ELVSS to the pixel unit 100. The first power supply voltage ELVDD is transmitted to a first power supply voltage line of the pixels 101, and the second power supply voltage ELVSS is transmitted to a second power supply voltage line of the pixels 101. The DC-DC converter 400 of FIG. 2 may include a set resistor, and may convert a reference voltage selected according to a set voltage determined by the set resistor into a power supply voltage and supply the power supply voltage to the plurality of pixels 101. Here, the power supply voltage may be the power supply voltage ELVDD or the second power supply voltage ELVSS. Although the following explanation will be made on the assumption that a reference voltage selected by a set voltage determined by a set resistor is converted into the first power supply voltage ELVDD and is supplied to the plurality of pixels 101, the present embodiment is not limited thereto and a reference voltage selected according to a set voltage determined by a set resistor may be converted into the second power supply voltage ELVSS.

Figure 3:
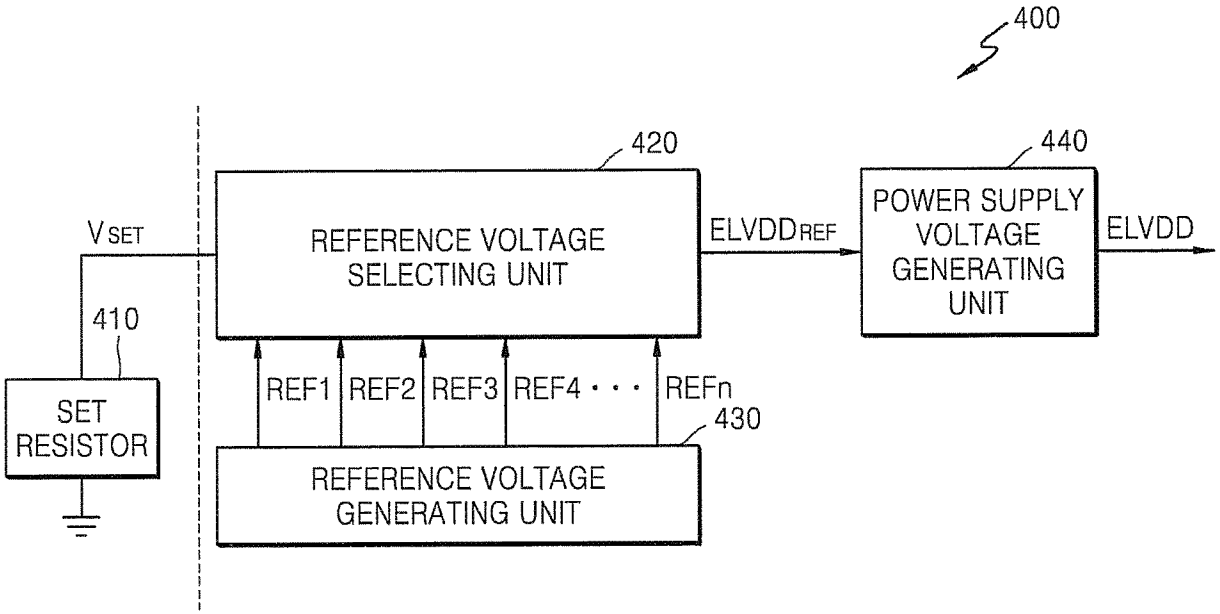
FIG. 3 is a block diagram illustrating a direct current (DC)-DC converter of the organic electroluminescent display device of FIG. 2.

FIG. 3 is a block diagram illustrating the DC-DC converter 400 of the organic electroluminescent display device of FIG. 2.

Referring to FIG. 3, the DC-DC converter 400 includes a set resistor 410, a reference voltage selecting unit 420, a reference voltage generating unit 430, and a power supply voltage generating unit 440.

The set resistor 410 may be located separate from the other elements of the DC-DC converter 400, and the set resistor 410 may have a resistance that may be arbitrarily varied by a manufacturer. The set resistor 410 may be a variable resistor and is exchangeable with a resistor having another resistance. Since the resistance of the set resistor 410 may be arbitrarily controlled by the manufacturer, the first power supply voltage ELVDD as desired by the manufacturer may be obtained. Accordingly, the DC-DC converter 400 may be commonly used for display devices in which the first power supply voltage ELVDD required by each of the display devices is different.

The reference voltage selecting unit 420 includes a set node (not shown) to which a set voltage $V_{SET}$ determined by the set resistor 410 is applied, and selects one reference voltage from among a plurality of reference voltages REF1, REF2, REF3, REF4, . . . , REFn according to the set voltage $V_{SET}$. The reference voltage selecting unit 420 may include a comparing unit (not shown) for comparing the set voltage $V_{SET}$ with a comparative voltage, and a selecting unit (not shown) for selecting one reference voltage from among the plurality of reference voltages REF1, REF2, REF3, REF4, . . . , REFn according to a result of a comparison performed by the comparing unit.

The reference voltage generating unit 430 generates the plurality of reference voltages REF1, REF2, REF3, REF4, . . . , REFn and applies the plurality of reference voltages REF1, REF2, REF3, REF4, . . . , REFn to the reference voltage selecting unit 420. Although n reference voltages (n is a natural number) are illustrated in FIG. 3, the number of reference voltages generated by the reference voltage generating unit 430 are not limited, and the number of reference voltages may vary according to the manufacturer's needs.

The power supply voltage generating unit 440 receives a reference voltage selected by the reference voltage selecting unit 420, that is, a selected reference voltage $ELVDD_{REF}$, and converts the selected reference voltage $ELVDD_{REF}$ into the first power supply voltage ELVDD to be supplied to the plurality of pixels 101. For example, the power supply voltage generating unit 440 may generate the first power supply voltage ELVDD from the selected reference voltage $ELVDD_{REF}$ through voltage division. However, a method of generating the first power supply voltage ELVDD in the power supply voltage generating unit 440 is not limited thereto, and various other methods may be used.

Figure 4:
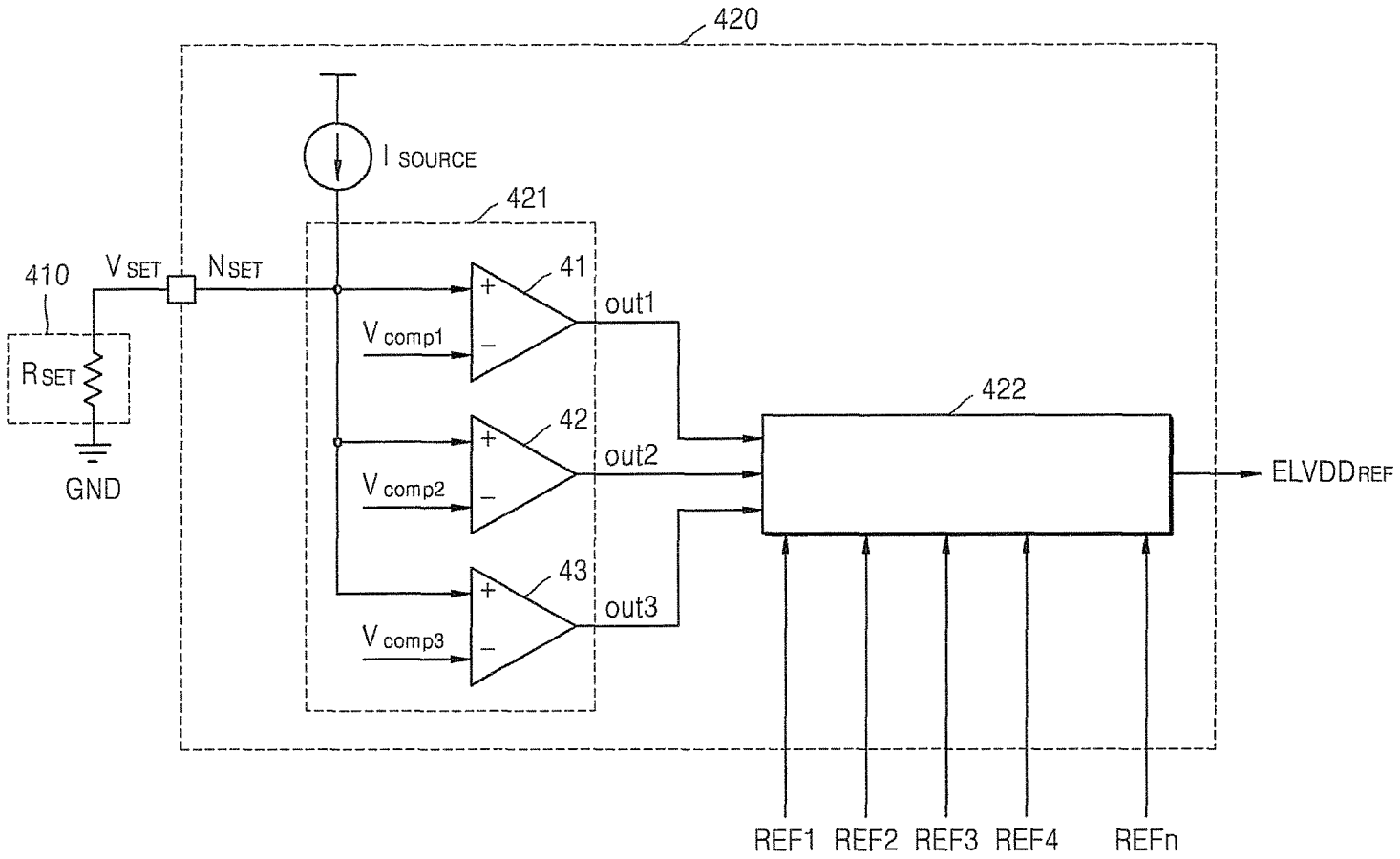
FIG. 4 is a circuit diagram illustrating the DC-DC converter illustrated in FIG. 3.

FIG. 4 is a circuit diagram illustrating the DC-DC converter 400 illustrated in FIG. 3. Referring to FIG. 4, the set resistor 410 and a comparing unit 421 and a selecting unit 422 included in the reference voltage selecting unit 420 are illustrated in detail.

A set resistor RSET of the set resistor 410 has a first terminal connected to ground GND, and a second terminal electrically connected to a set node $N_{SET}$. A current supplied from a current generating unit $I_{SOURCE}$ and the set voltage $V_{SET}$, generated by the set resistor $R_{SET}$, are applied to the set node $N_{SET}$.

The comparing unit 421 may include at least one comparator having a first terminal to which the set voltage $V_{SET}$ is applied and a second terminal to which a comparative voltage is applied, and designed to output an output value by comparing the set voltage $V_{SET}$ with the comparative voltage. Referring to FIG. 4, the comparing unit 421 may include a first comparator 41 having a first terminal electrically connected to the set node $N_{SET}$ and to which the set voltage $V_{SET}$ is applied and a second terminal to which a first comparative voltage Vcomp1 is applied, and designed to output a first output value out1 by comparing the set voltage $V_{SET}$ with the first comparative voltage Vcomp1; a second comparator 42 having a first terminal electrically connected to the set node $N_{SET}$ and to which the set voltage $V_{SET}$ is applied and a second terminal to which a second comparative voltage Vcomp2 is applied, and designed to output a second output value out2 by comparing the set voltage $V_{SET}$ with the second comparative voltage Vcomp2; and a third comparator 43 having a first terminal electrically connected to the set node $N_{SET}$ and to which the set voltage $V_{SET}$ is applied and a second terminal to which a third comparative voltage Vcomp3 is applied, and designed to output a third output value out3 by comparing the set voltage $V_{SET}$ with the third comparative voltage Vcomp3. For example, in a comparator, if a voltage applied to a first terminal is greater than a voltage applied to a second terminal, the comparator may output a logic signal with a low level as an output value, and if a voltage applied to the first terminal is less than a voltage applied to the second terminal, the comparator may output a logic signal with a high level as an output value. Although three operational amplifiers are illustrated as the first through third comparators 41, 42, and 43 in FIG. 4, the number of comparators, types of the comparators, and a method of driving the comparators are not limited to those described above, and may vary in many ways.

The selecting unit 422 selects a reference voltage corresponding to a combination of the first output value out1, the second output value out2, and the third output value out3 obtained as a result of a comparison performed by the comparing unit 421. For example, if the first output value out1 is a logic signal with a low level, the second output value out2 is a logic signal with a low level, and the third output value out3 is a logic signal with a high level, a reference voltage corresponding to the combination of the first through third output values out1 through out3 may be selected. The selected reference voltage, that is, the selected reference voltage $ELVDD_{REF}$, is applied to the power supply voltage generating unit 440.

Table 1 shows data that may be obtained by the DC-DC converter 400 illustrated in FIG. 3.

TABLE 1

| $I_{SOURCE}$ | $R_{SET}$ | $V_{SET}$ | $ELVDD_{REF}$ | ELVDD |
|---|---|---|---|---|
| 5 μA | 50 kΩ | 0.25 V | REF1 | 3.1 V |
| 5 μA | 150 kΩ | 0.75 V | REF2 | 3.2 V |
| 5 μA | 250 kΩ | 1.25 V | REF3 | 3.3 V |
| 5 μA | 450 kΩ | 2.25 V | REF4 | 3.4 V |

Referring to FIG. 4 and Table 1, assuming that a current of 5 μA generated by the current generating unit $I_{SOURCE}$ flows to the set resistor $R_{SET}$, when the set resistor $R_{SET}$ has a resistance of 50 kΩ, 150 kΩ, 250 kΩ, or 450 kΩ, the set voltage $V_{SET}$ applied to the set node $N_{SET}$ is 0.25 V, 0.75 V, 1.25 V, or 2.25 V, respectively. It is assumed that the set voltage $V_{SET}$ as 0.25 V, 0.75 V, 1.25 V, or 2.25 V is applied to the comparing unit 421 of FIG. 3. When the set resistor $R_{SET}$ has a resistance of 50 kΩ, the selecting unit 422 selects a first reference voltage REF1. When the set resistor $R_{SET}$ has a resistance of 150 kΩ, the selecting unit 422 selects a second reference voltage REF2. When the set resistor $R_{SET}$ has a resistance of 250 kΩ, the selecting unit 422 selects a third reference voltage REF3. Finally, when the set resistor $R_{SET}$ has a resistance of 450 kΩ, the selecting unit 422 selects a fourth reference voltage REF4. A reference voltage selected in this way, that is, the selected reference voltage $ELVDD_{REF}$, is applied to the power supply voltage generating unit 440. According to Table 1, when the set resistor $R_{SET}$ has a resistance of 50 kΩ, the first power supply voltage ELVDD is generated at 3.1 V, and when the set resistor 410 $R_{SET}$ has a resistance of 150 kΩ, the first power supply voltage ELVDD is generated at 3.2 V. Likewise, when the set resistor 410 $R_{SET}$ has a resistance of 250 kΩ, the first power supply voltage ELVDD is generated at 3.3 V, and when the set resistor 410 $R_{SET}$ has a resistance of 450 kΩ, the first power supply voltage ELVDD is generated at 3.4 V. However, current values of the power generating unit $I_{SOURCE}$, the set resistor $R_{SET}$, and the first power supply voltage ELVDD shown in Table 1 are exemplary, and the present embodiment is not limited thereto and various modifications may be made.

Figure 5:
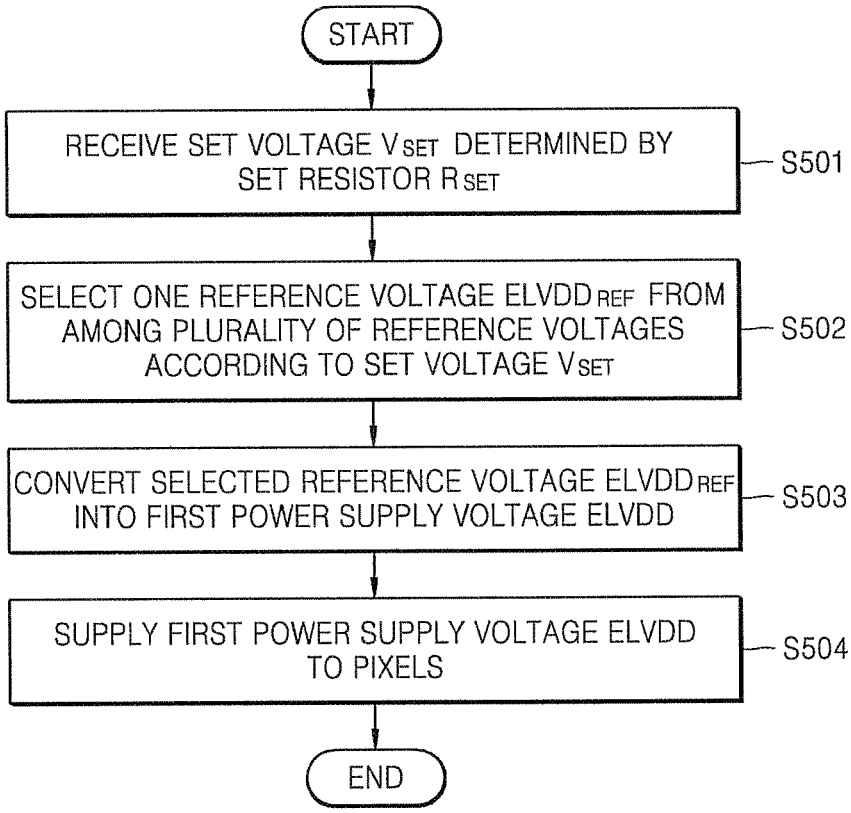
FIG. 5 is a flowchart illustrating a method of driving the organic electroluminescent display device of FIG. 2, according to an embodiment of the present invention.

FIG. 5 is a flowchart illustrating a method of driving the organic electroluminescent display device of FIG. 2, according to an embodiment of the present invention.

Referring to FIG. 5, in operation S501, the DC-DC converter 400 included in the organic electroluminescent display device of FIG. 2 receives the set voltage $V_{SET}$ determined by the set resistor $R_{SET}$. Here, the set resistor $R_{SET}$ may be located separate from the other elements of the DC-DC converter 400. The set resistor $R_{SET}$ may be exchangeable, and the set resistor $R_{SET}$ may have a resistance that is arbitrarily controlled by a manufacturer. Accordingly, the DC-DC converter 400 may be commonly used for various organic electroluminescent display devices.

In operation S502, one reference voltage from among the plurality of reference voltages REF1, REF2, REF3, REF4, . . . , REFn, that is, the selected reference voltage $ELVDD_{REF}$, is selected according to the set voltage $V_{SET}$. A method of selecting the selected reference voltage $ELVDD_{REF}$ in operation S502 has been described with reference to FIG. 4 in detail, and thus a detailed explanation thereof will not be given again.

In operation S503, the selected reference voltage $ELVDD_{REF}$ is converted into the first power supply voltage ELVDD. The selected reference voltage $ELVDD_{REF}$ may be converted into the first power supply voltage ELVDD through voltage division or various other methods. The first power supply voltage ELVDD is determined to be a value required by each of the pixels 101.

In operation S504, the first power supply voltage ELVDD is supplied to the plurality of pixels 101.

Figure 6:
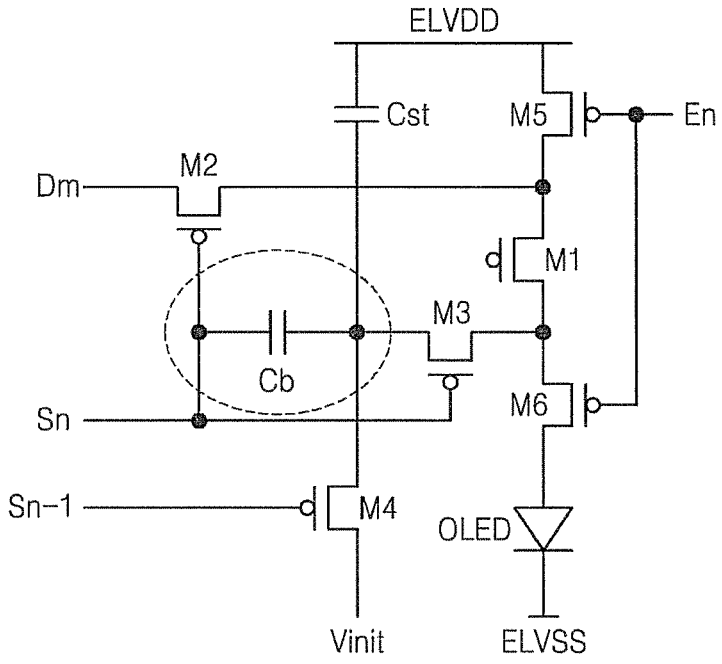
FIG. 6 is a circuit diagram illustrating a pixel circuit for explaining an effect of the present invention.
Figure 4:
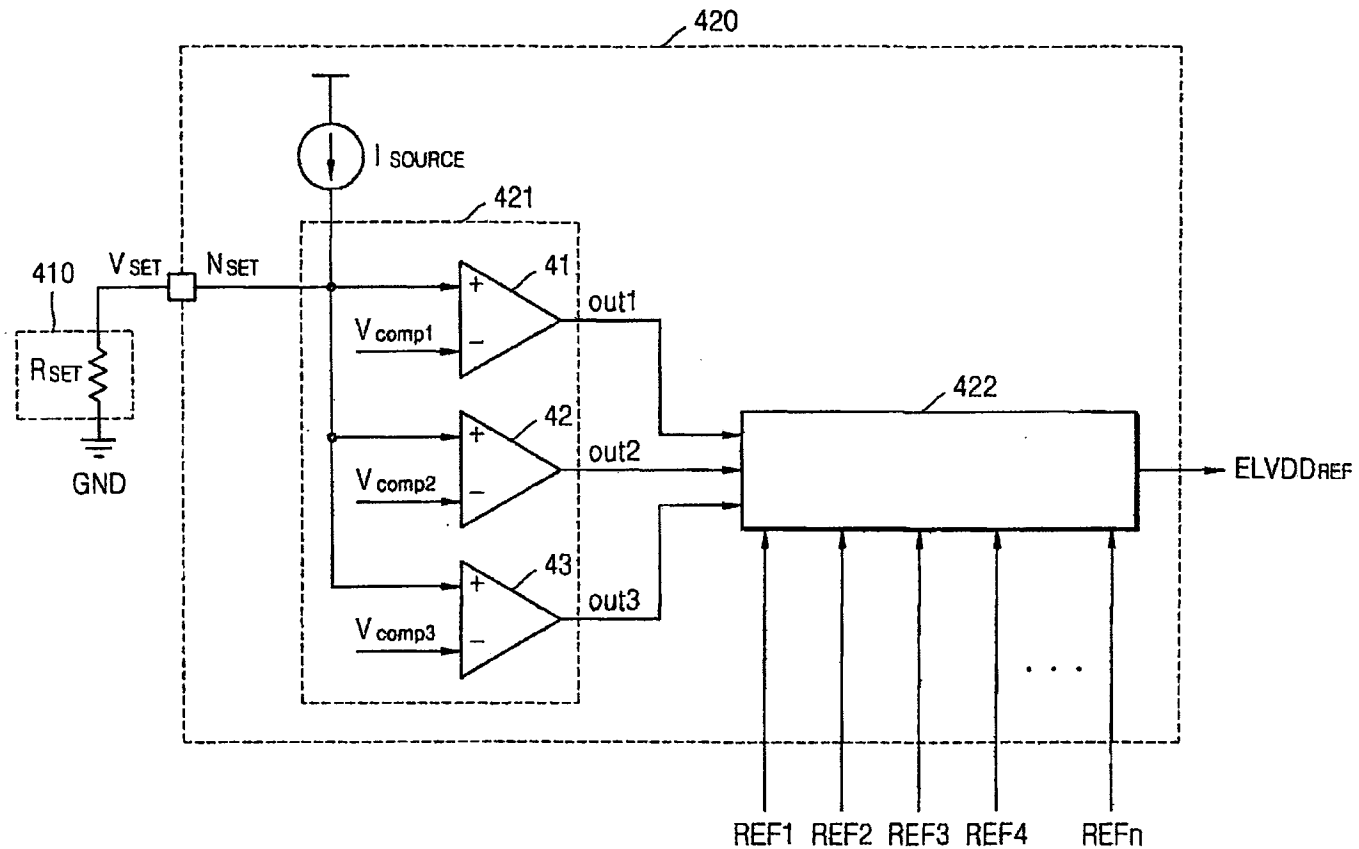

FIG. 6 is a circuit diagram illustrating a pixel circuit for illustrating an aspect of the present invention.

Referring to FIG. 6, the pixel circuit includes first through sixth transistors M1, M2, M3, M4, M5, and M6, a storage capacitor Cst, and a boost capacitor Cb. An $n^{th}$ scan line Sn, an $n-1^{th}$ scan line Sn−1, an $n^{th}$ light-emitting control line En, and a data line Dm are electrically connected to the pixel circuit, and an initial voltage Vinit is applied to the pixel circuit.

In order to adjust a black level, the pixel circuit of FIG. 6 employs the boost capacitor Cb. The boost capacitor Cb boosts a data voltage to compensate for a voltage difference between the data voltage and the first power supply voltage ELVDD, thereby making a black level constant. However, if the boost capacitor Cb is added to the pixel circuit, there is a limitation in design and stains occur. However, if the boost capacitor Cb is removed from the pixel circuit, the data voltage may not be boosted and the voltage difference between the data voltage and the first power supply voltage ELVDD may remain high. However, such problems may be solved by decreasing or increasing the first power supply voltage ELVDD according to an embodiment of the present invention. In detail, a manufacturer may control the first power supply voltage ELVDD by adjusting the resistance of the set resistor $R_{SET}$ of the DC-DC converter 400. Accordingly, a black level may be easily adjusted even without the boost capacitor Cb.

Furthermore, even with the set resistor $R_{SET}$ having a resistance that is relatively imprecise, the first power supply voltage ELVDD as desired by the manufacturer may be obtained. That is because even though there is a deviation in the resistance of the set resistor $R_{SET}$, the deviation is compensated for by the comparing unit 421 and the selecting unit 422 and thus the selected reference voltage $ELVDD_{REF}$ as desired may be determined.

As described above, since a black level is adjusted by using a power supply voltage supplied to pixels and a device used in a conventional method is no longer necessary, a design limitation may be avoided, and a high quality image may be displayed.

Accordingly a desired power supply voltage may be obtained by even using a set resistor that is relatively imprecise, and the DC-DC converter according to an aspect of the present invention may be commonly used for display devices requiring different power supply voltages.

While the present invention has been particularly shown and described with reference to exemplary embodiments thereof using specific terms, the embodiments and terms have been used to explain the present invention and should not be construed as limiting the scope of the present invention defined by the claims. The preferred embodiments should be considered in a descriptive sense only and not for purposes of limitation. Therefore, the scope of the invention is defined not by the detailed description of the invention but by the appended claims, and all differences within the scope will be construed as being included in the present invention.

All references, including publications, patent applications, and patents, cited herein are hereby incorporated by reference to the same extent as if each reference were individually and specifically indicated to be incorporated by reference and were set forth in its entirety herein.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic electroluminescent display device comprising:

a plurality of scan lines arranged in a row direction;

a plurality of data lines arranged in a column direction;

a plurality of pixels formed at intersections between the plurality of scan lines and the plurality of data lines; and a direct current (DC)-DC converter to supply a power supply voltage to the plurality of pixels, wherein the DC-DC converter comprises a set resistor, and is configured to convert one reference voltage selected according to a set voltage determined by the set resistor into a power supply voltage and is configured to supply the power supply voltage to the plurality of pixels, wherein the DC-DC converter further comprises:

a reference voltage generating unit configured to generate a plurality of reference voltages;

a reference voltage selecting unit configured to select the one reference voltage from among the plurality of reference voltages according to the set voltage determined by the set resistor; and a power supply voltage generating unit configured to convert the selected one reference voltage into the power supply voltage to be supplied to the plurality of pixels.

2. The organic electroluminescent display device of claim 1, wherein the set resistor is exchangeable, and has a resistance that is variable.

3. The organic electroluminescent display device of claim 1, wherein the set resistor is located separate from the reference voltage generating unit, the reference voltage selecting unit, and the power supply voltage generating unit.

4. The organic electroluminescent display device of claim 1, wherein the reference voltage selecting unit comprises:

a comparing unit configured to compare the set voltage with a comparative voltage; and a selecting unit configured to select the one reference voltage from among the plurality of reference voltages according to a result of the comparison performed by the comparing unit.

5. The organic electroluminescent display device of claim 4, wherein the comparing unit comprises at least one comparator comprising a first terminal to which the set voltage is applied and a second terminal to which the comparative voltage is applied, and the comparing unit is configured to output an output value by comparing the set voltage with the comparative voltage.

6. The organic electroluminescent display device of claim 5, wherein the selecting unit is configured to select the one reference voltage according to the output value of the at least one comparing unit.

7. A DC-DC converter comprising:

a set resistor;

a reference voltage generating unit to generate a plurality of reference voltages;

a reference voltage selecting unit to select one reference voltage from among the plurality of reference voltages according to a set voltage determined by the set resistor; and a power supply voltage generating unit to convert the selected reference voltage into a power supply voltage to be supplied to a plurality of pixels.

8. The DC-DC converter of claim 7, wherein the set resistor is exchangeable, and has a resistance that is variable.

9. The DC-DC converter of claim 7, wherein the set resister is located separate from the reference voltage generating unit, the reference voltage selecting unit, and the power supply voltage generating unit.

10. The DC-DC converter of claim 7, wherein the reference voltage selecting unit comprises:

a comparing unit to compare the set voltage with a comparative voltage; and a selecting unit to select the one reference voltage from among the plurality of reference voltages according to a result of the comparison performed by the comparing unit.

11. The DC-DC converter of claim 10, wherein the comparing unit comprises at least one comparator comprising a first terminal to which the set voltage is applied and a second terminal to which the comparative voltage is applied, and to the comparing unit outputs an output value by comparing the set voltage with the comparative voltage.

12. The DC-DC converter of claim 11, wherein the selecting unit selects the one reference voltage according to the output value of the at least one comparator.

13. A method of driving an organic electroluminescent display device comprising a plurality of scan lines arranged in a row direction, a plurality of data lines arranged in a column direction, a plurality of pixels formed at intersections between the plurality of scan lines and the plurality of data lines, and a DC-DC converter for supplying a power supply voltage to the plurality of pixels, the method comprising:

receiving a set voltage determined by a set resistor;

selecting one reference voltage from among a plurality of reference voltages according to the set voltage; and converting the selected reference voltage into a power supply voltage and supplying the power supply voltage to the plurality of pixels.

14. The method of claim 13, wherein the set resistor is exchangeable, and has a resistance that is variable.

15. The method of claim 13, wherein the set resistor is located separate from other elements of the DC-DC converter.

16. A method of driving a DC-DC converter for supplying a power supply voltage to a plurality of pixels, the method comprising:

receiving a set voltage determined by a set resistor;

selecting one reference voltage from among a plurality of reference voltages according to the set voltage; and converting the selected reference voltage into a power supply voltage and supplying the power supply voltage to the plurality of pixels.

17. The method of claim 16, wherein the set resistor is exchangeable, and has a resistance that is variable.

18. The method of claim 16, wherein the set resistor is located separate from other elements of the DC-DC converter.

19. The method of claim 13, wherein the selecting of the one reference voltage further comprises comparing the set voltage with a comparative voltage.

20. The method of claim 16, wherein the selecting of the one reference voltage further comprises comparing the set voltage with a comparative voltage.

* * * * *

UNITED STATES PATENT AND TRADEMARK OFFICE

CERTIFICATE OF CORRECTION

PATENT NO. : 8,570,251 B2
APPLICATION NO. : 12/984943
DATED : October 29, 2013
INVENTOR(S) : Sung Cheon Park It is certified that error appears in the above-identified patent and that said Letters Patent is hereby corrected as shown below:

Delete title page and substitute the attached title page therefor.

In the Drawings

| | |
|---|---|
| Sheet 4 of 6, FIG. 4 | Delete Drawing Sheet 4 and substitute therefore the Drawing Sheet, consisting of FIG. 4, as shown on the attached page.<br>Insert -- • • • -- |

In the Claims

| | |
|---|---|
| Column 10, Claim 9, line 51 | Delete "resister"<br>Insert -- resistor -- |
| Column 10, Claim 11, line 66 | After "and"<br>Delete "to" |

Signed and Sealed this
Twenty-sixth Day of May, 2015

Michelle K. Lee

Michelle K. Lee
*Director of the United States Patent and Trademark Office*

(12) United States Patent
Park

(10) Patent No.: US 8,570,251 B2
(45) Date of Patent: Oct. 29, 2013

(54) DC-DC CONVERTER, ORGANIC ELECTROLUMINESCENT DISPLAY DEVICE INCLUDING THE SAME, AND METHOD OF DRIVING THE ORGANIC ELECTROLUMINESCENT DISPLAY DEVICE

(75) Inventor: Sung Cheon Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 375 days.

(21) Appl. No.: 12/984,943

(22) Filed: Jan. 5, 2011

(65) Prior Publication Data

US 2011/0273111 A1 Nov. 10, 2011

(30) Foreign Application Priority Data

May 6, 2010 (KR) ..... 10-2010-0042584

(51) Int. Cl.
*G09G 3/30* (2006.01)

(52) U.S. Cl.
USPC ..... 345/76; 345/211; 315/169.3

(58) Field of Classification Search
USPC ..... 315/55, 76, 77, 204, 211, 169.3, 169.1; 345/55, 76, 77, 204, 211
See application file for complete search history.

(56) References Cited

U.S. PATENT DOCUMENTS

| | | | |
|---|---|---|---|
| 2002/0015033 | A1 | 2/2002 | Kim |
| 2003/0043090 | A1 * | 3/2003 | Yazawa et al. ..... 345/76 |

FOREIGN PATENT DOCUMENTS

| | | |
|---|---|---|
| JP | 2004-266674 | 9/2004 |
| JP | 3748262 | 12/2005 |
| JP | 2006-340587 | 12/2006 |
| KR | 10-0348275 B1 | 8/2002 |
| KR | 10-2004-0061488 | 7/2004 |
| KR | 10-2007-0063737 A | 6/2007 |
| KR | 10-2007-0099800 A | 10/2007 |
| KR | 10-2008-0062774 A | 7/2008 |
| KR | 10-2008-0082047 | 9/2008 |
| KR | 10-2008-0090879 | 10/2008 |
| KR | 10-2008-0095024 | 10/2008 |
| KR | 10-2009-0095135 | 9/2009 |

OTHER PUBLICATIONS

KIPO Registration Determination Certificate dated Apr. 18, 2012, for Korean Patent application 10-2010-0042583, (5 pages).
KIPO Registration Determination Certificate dated Nov. 18, 2011, for Korean priority Patent application 10-2010-0042584, noting listed references in this IDS, 5 pages.
English-language abstract of Japanese Publication No. 2005-020833.
U.S. Appl. No. 13/005,974, filed Jan. 13, 2011, Sung Cheon Park, Samsung Mobile Display Co., Ltd.

* cited by examiner

*Primary Examiner* — David H Vu
(74) *Attorney, Agent, or Firm* — Christie, Parker & Hale, LLP

(57) ABSTRACT

In order to adjust a black level by using a power supply voltage, an organic electroluminescent display device includes: a plurality of scan lines arranged in a row direction; a plurality of data lines arranged in a column direction; a plurality of pixels formed at intersections between the plurality of scan lines and the plurality of data lines; and a direct current (DC)-DC converter to supply a power supply voltage to the plurality of pixels, wherein the DC-DC converter includes a set resistor, and to convert a reference voltage selected according to a set voltage determined by the set resistor into a power supply voltage and to supply the power supply voltage to the plurality of pixels.

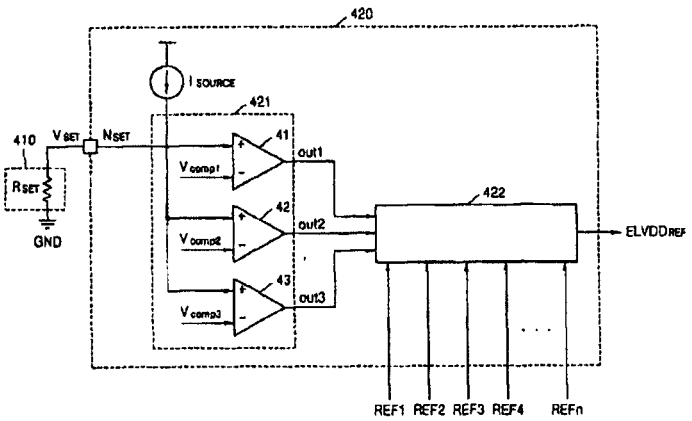

20 Claims, 6 Drawing Sheets